United States Patent [19]

Klak et al.

[11] Patent Number: 4,624,226

[45] Date of Patent: Nov. 25, 1986

[54] DEVICE FOR HEATING THE GLOW PLUGS OF INTERNAL COMBUSTION ENGINES

[75] Inventors: Roland Klak, Ostfildern; Olaf Büchner, Stuttgart, both of Fed. Rep. of Germany

[73] Assignee: Daimler-Benz Aktiengesellschaft, Stuttgart, Fed. Rep. of Germany

[21] Appl. No.: 673,919

[22] Filed: Nov. 21, 1984

[30] Foreign Application Priority Data

Nov. 26, 1983 [DE] Fed. Rep. of Germany ..... 3342865

[51] Int. Cl.[4] ..... F02P 19/02

[52] U.S. Cl. ..... 123/179 H; 123/145 A

[58] Field of Search ..... 123/179 BG, 179 B, 179 H, 123/145 A

[56] References Cited

U.S. PATENT DOCUMENTS

| | | | |
|---|---|---|---|
| 4,285,307 | 8/1981 | Steinke | 123/179 BG |
| 4,307,689 | 12/1981 | Raeske et al. | 123/179 H |
| 4,391,237 | 7/1983 | Abe et al. | 123/145 A |
| 4,399,781 | 8/1983 | Tsukasaki | 123/179 BG |
| 4,491,100 | 1/1985 | Yasuhara | 123/179 BG |

FOREIGN PATENT DOCUMENTS

| | | | |
|---|---|---|---|
| 2306372 | 8/1974 | Fed. Rep. of Germany . | |
| 2743059 | 4/1979 | Fed. Rep. of Germany . | |
| 2840640 | 3/1980 | Fed. Rep. of Germany | 123/179 BG |

*Primary Examiner*—Andrew M. Dolinar

*Attorney, Agent, or Firm*—Barnes & Thornburg

[57] ABSTRACT

A device for heating the glow plugs of internal combustion engines, particularly in flame starting systems, in which there is provided a retriggerable monostable time function element which is triggered if a control voltage exceeds a specific value, and a continuous and subsequently a pulsatory current being supplied until the end of the stationary time of the retriggerable monostable time function element of the glow plug, there being provided a temperature switch which switches on below a specific first engine temperature value and switches off above a specific second engine temperature value and through which the operating voltage is applied to the device. The intended achievement is that the heating of the glow plug is reduced only if the internal combustion engine has run for a specific period of time.

3 Claims, 2 Drawing Figures

DEVICE FOR HEATING THE GLOW PLUGS OF INTERNAL COMBUSTION ENGINES

The invention relates to a device for heating the glow plugs of internal combustion engines particularly in flame starting systems, wherein a continuous current and, subsequently, a pulsatory current is fed to the glow plugs until a specific operating point is reached.

A device of this type is known from German Offenlegungsschrift No. 27 43 059.

A flame starting system for internal combustion engines is used for starting at temperatures below the normal critical starting temperature. It produces steadier running of the engine in a shorter time and prevents the so-called "white smoke" during the warm-up phase. The known device cannot be used in flame starting systems because the glow plug therein is fitted in the induction pipe and, during the starting operation, is cooled considerably by passing air, vaporizing fuel and a decrease of voltage. Therefore, a switchover to a lower heating capacity may only take place when the engine has been run for a specific time.

It is an object of the invention to provide a device which overcomes the shortcomings of the prior art.

It is an object of the invention to develop the known device to the extent that it can also be used for flame starting systems.

This object is achieved in accordance with the invention by the provision of a retriggerable monostable time function element which is triggered if a control voltage (D+) exceeds a specific value, the end of the inactive time of the retriggerable monostable time function element being the specific operating point, and there is provided a temperature switch which switches on below a specific first engine temperature value and switches off above a specific second engine temperature value and through which the device is connected to the terminal of an operating voltage.

These features make it possible, in a simple manner, for the full heating temperature of the glow plug to be maintained until the engine is running reliably and, subsequently, for a lower heating temperature to be maintained until the engine has reached a specific operating temperature.

These and other objects, features, and advantages of the present invention will become more apparent from the following description when taken in connection with the accompanying drawing which shows, for the purpose of illustration only, one embodiment in accordance with the present invention, and wherein.

Figure 1:
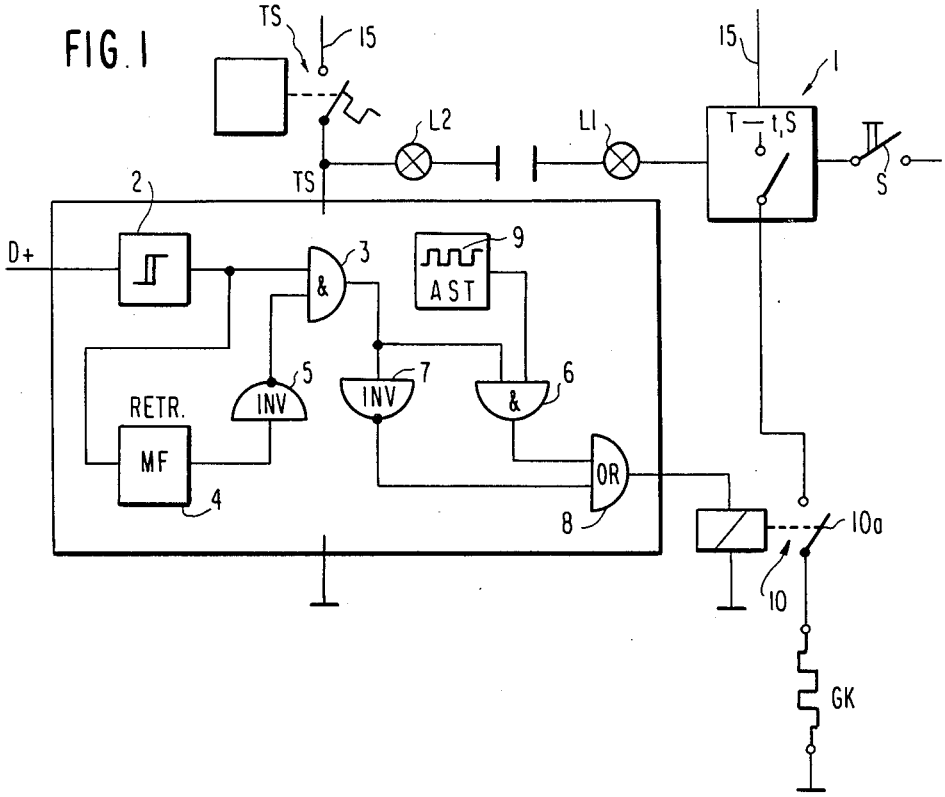
FIG. 1 shows a circuit diagram of the device according to the invention.

A circuit diagram of a device for heating the glow plug(s) of a flame starting system for an internal combustion engine is shown in FIG. 1 wherein like features carry like reference numerals. A device 1, which can be switched on via a touch contact switch S and which determines the preheat period for the glow plug GK in accordance with the ambient temperature or engine temperature, the end of this preheat period being followed by activation of a lamp L1 indicating starting readiness, and which switches the glow plug off again after a safe period of time if starting has not occurred by then and preheating has ended, is known per se.

Via a temperature switch TS which switches on at a specific first engine temperature, for example +5° C., and switches off at a specific second engine temperature, for example +20° C., the following circuit is connected to the terminal 15 of the vehicle's voltage supply, and also a lamp L2 which, when illuminated, indicates that the flame starting system should be switched on (via the touch contact switch S) prior to starting. The fuel injection valve which forms part of the flame starting system is not shown.

The circuit of FIG. 1 is shown diagrammatically by logic elements to explain the mode of operation. In this connection the level H shall be equivalent to the potential of the positive pole and the level L to the potential of the negative pole of the vehicle's voltage supply.

Apart from the vehicle's voltage which should be considered as the signal of the temperature switch TS actuated by response to engine temperature, the potential at the terminal D+ (=control voltage) of the dynamo regulator (not shown) is provided as the second input quantity. When the internal combustion engine is not running, this potential lies at the potential of the negative pole of the vehicle's voltage supply and, when the engine is running at the idling speed, it lies at the potential of the charging voltage for the battery (also not shown). The potential between the stationary position and the idling speed is dependent on the speed in each case.

A Schmitt trigger 2 checks whether the control voltage at the terminal D+ exceeds a specific value at which the internal combustion engine has reached sufficient speed. If this is the case, an H-signal is formed at the output of the Schmitt trigger. The output signal of the Schmitt trigger is transmitted to one input of a first AND element 3 and to the input of a retriggerable monostable multivibrator 4 which is triggered by the positive edge of the output signal of the Schmitt trigger 2. The output of the multivibrator or trigger circuit 4 is followed by a first inverter 5 having its output connected to the second input or the first AND element 3. The output of the first AND element 3 is connected to the first input of a second AND element 6 and to the input of a second invertor 7. Connected to the second input of the second AND element 6 is the output of an astable multivibrator 9 which generates a rectangular signal having a specific pulse-duty factor as long as voltage is applied via the temperature switch TS. The output of the second inverter 7 and the output of the second AND element 6 lead to the inputs of an OR element 8, the output signal of which acts on the exciting winding of a relay 10 which has a make contact 10*a* arranged between the device 1 and the glow plug GK.

The mode of operation of the device is explained below with the aid of the pulse diagram according to FIG. 2.

The following signal variations in relation to time are plotted one below another in FIG. 2.

1. the signal of the temperature switch TS,
2. the voltage at the starter (not shown),
3. the output signal of the retriggerable monostable multivibrator and, with dashes, the output signal of the Schmitt trigger, and
4. the voltage at the glow plug.

If a voltage is applied to terminal 15 via the ignition lock (not shown) within the time D and the engine temperature is less than +5° C., the temperature switch TS is closed and the vehicle's voltage supply to the device is switched on. Since the engine is stationary, that is, not running, the control voltage D+ is at negative potential. The lamp L2 lights up, i.e., the flame starting system is to be actuated.

Since D+ is below the specific value, the output of the Schmitt trigger 2 conducts to produce the L signal and, thus, the outputs of the first and second AND elements 3 and 6 also transmit the L signal. However, this signal is inverted in the second inverter 7 to form the H signal which excites the relay 10 via the OR element 8.

Figure 2:
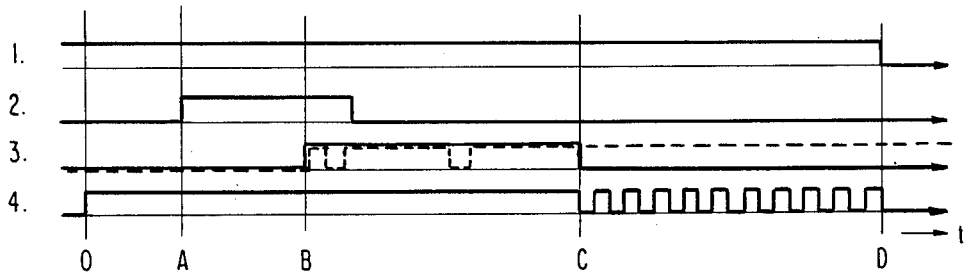
FIG. 2 shows a pulse diagram to explain the function of the device according to FIG. 1.

If the flame starting system (device 1) is now switched on at time D, FIG. 2, via the touch contact switch S, the glow plug GK is preheated for a period of time associated with the engine temperature. If this time has expired, the lamp L1 lights up and indicates that starting can take place (time A). During the starting operation the control voltage at D+ increases according to the speed of the dynamo or engine. If it exceeds the specific value set in the Schmitt trigger 2, the output of the latter changes to the H signal at time B thereby triggering the monostable multivibrator 4, the output signal of which also changes to the H signal which is, however, inverted in the first inverter 5 and in turn inhibits the two AND elements 3 and 6. The glow plug GK is therefore also heated by continuous current.

Since the idling speed is not immediately reached and maintained when starting at low temperatures, it may happen that the control voltage D+ falls below and again exceeds the set threshold value several more times, as a result of which the output signal of the Schmitt trigger 2 also changes several more times from the H signal to the L signal and back again. Each new rise in this signal triggers the monostable multivibrator 4 once more so that its output signal is lengthened.

If the starting operation is completed and the output signal of multivibrator 4 is terminated by the expiry of the inactive time without retriggering (time C), then the H signal appears at the output of the Schmitt trigger 2 if the engine is running. The L signal, which is to be inverted in the first inverter 5 to form the H signal, appears at the output of the monostable multivibrator 4. Both inputs of the first AND element 3 transmit the H signal whereby its output also changes to the H signal. Thus, the output of the second inverter 7 changes to the L signal and the first input of the second and element 6 to the H signal. Thus, the rectangular signal of the astable multivibrator 9 passes via OR element 8 to the relay 10, the make contact **10*a* of which now switches on and off in synchronization with the rectangular signal, whereupon only pulsating current is still fed to the glow plug from the operating point until the engine temperature has increased to 20° C. (time D). Then the temperature switch TS actually opens and interrupts the voltage supply whereby the relay 10 moves into the inoperative position when the make contact 10*a*** is open and the heating or flame starting operation is terminated.

With the lamp L1 lighting up, the safe period begins and is interrupted by a successful starting operation as described above.

If, however, no control signal appears at D+ or it fails to appear again (the engine is stationary, that is, not running), the heating current is cut off after the safe period expires and the flame starting operation is terminated.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A device for controlling heating of glow plugs in a flame starting system of an internal combustion engine and causing the glow plugs, until a certain operating point is reached, to receive the maximum current, a temperature switch which allows a reduced current to be supplied to the glow plugs from this operating point until a predetermined engine temperature value is reached for supplying an operating voltage to said device, wherein said device includes a retriggerable monostable time function element that is triggered to generate an output signal for a predetermined time period when a control voltage exceeds a certain value, wherein the end of the predetermined time period of the retriggerable monostable time function element is the certain operating point, and wherein the temperature switch closes below a certain first engine temperature value and opens above a second engine temperature value, and wherein, via said temperature switch, the operating voltage for the device is switched on and off.

2. A flame starting control system for heating a glow plug of an internal combustion engine comprising input means for producing a first signal as a function of engine speed, means for generating a second signal as a function of engine temperature, means for generating an output to control the preheat period of the glow plug in response to one of ambient temperature and engine temperature, and means responsive to the first signal and the second signal for controlling application of said output to said glow plug, wherein said means responsive to the first and second signal comprises a retriggerable monostable time function multivibrator responsive to said input means and generating a signal when said engine speed reaches a predetermined positive threshold value, logic circuit means responsive to the presence of an output of said retriggerable monostable time function multivibrator for producing a continuous third signal to control application of said output to said glow plug.

3. A flame starting control system for heating a glow plug of an internal combustion engine comprising input means for producing a first signal as a function of engine speed, means for generating a second signal as a function of engine temperature, means for generating an output to control the preheat period of the glow plug in response to one of ambient temperature and engine temperature, and means responsive to the first signal and the second signal for controlling application of said output to said glow plug, wherein said means responsive to the first and second signal comprises a retriggerable monostable time function multivibrator responsive to said input means and generating a signal when said engine speed reaches a predetermined threshold value, logic circuit means responsive to the presence of an output of said retriggerable monostable time function means for producing a continuous third signal to control application of said output to said glow plug, and means producing a pulse train having a predetermined duty factor, the pulse train being produced in response to a presence of said second signal generated by said means for generating a second signal, said pulses of said pulse train serving for sequentially blocking and unblocking said output applied to said glow plug synchronously with each pulse of the pulse train.

* * * * *